US006371601B1

(12) United States Patent
Katakura

(10) Patent No.: US 6,371,601 B1
(45) **Date of Patent: *Apr. 16, 2002**

(54) INK JET TYPE RECORDING HEAD

(75) Inventor: Takahiro Katakura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/507,680

(22) Filed: Feb. 22, 2000

Related U.S. Application Data

(62) Division of application No. 08/901,787, filed on Jul. 28, 1997, now Pat. No. 6,042,223.

(30) Foreign Application Priority Data

Jul. 26, 1996 (JP) ..... 8-215098
Feb. 6, 1997 (JP) ..... 9-38308

(51) Int. Cl.[7] ..... B41J 2/045
(52) U.S. Cl. ..... 347/68
(58) Field of Search ..... 347/68–71, 40, 347/41

(56) References Cited

U.S. PATENT DOCUMENTS 4,730,197 A * 3/1988 Raman et al. ..... 347/68
5,160,945 A 11/1992 Drake ..... 347/42
5,790,155 A 8/1998 Utsui et al. ..... 347/68
5,889,539 A 3/1999 Kamoi et al. ..... 347/70
6,155,677 A * 12/2000 Kitani et al. ..... 347/65

FOREIGN PATENT DOCUMENTS

EP 0 426 473 5/1991 ..... B41J/2/155
EP 0 653 304 5/1995 ..... B41J/2/14
JP 61 283554 12/1986 ..... B41J/3/04

* cited by examiner

*Primary Examiner*—John Barlow
*Assistant Examiner*—Michael S Brooke
(74) *Attorney, Agent, or Firm*—Sughrue Mion, PLLC

(57) ABSTRACT

Pressure generating units 1, 2 are formed so as to be inclined at an angle θ with respect to pressure generating chamber 4, 5 arraying lines. A plurality of pressure generating units are fixed to a passage unit 6 so as to be shifted in such a manner that the plurality of pressure generating units neighbor at end faces in a pressure generating chamber 4, 5 arraying direction and in such a manner that a pressure generating chamber 4, 5 arraying pitch between the confronting pressure generating units 1, 2 becomes equal to a pressure generating chamber 4, 5 arraying pitch designed for a pressure generating unit. Further, such pressure generating units 1, 2 are arranged in a plurality of arrays A, B, C in a recording head moving direction, and reservoirs 8, 9 are formed so as to cross over the pressure generating units 1, 2 per each of the plurality of arrays A, B, C. Ink introducing ports 11, 12 are formed at stepped portions in a boundary region between the pressure generating units 1, 2.

6 Claims, 12 Drawing Sheets

INK JET TYPE RECORDING HEAD

This is a divisional of Application No. 08/901,787 filed Jul. 28, 1997 now U.S. Pat. No. 6,042,223, the disclosure of which is incorporated herein by reference.

BACKGROUND OF THE INVENTION

1. Field of the Invention

The present invention relates to an ink jet type recording head in which a piezoelectric vibrator or other pressure generating means is provided in a region of a pressure generating chamber communicating with a nozzle opening. Ink drops are generated when the pressure generating chamber is compressed by the deflection vibration of the piezoelectric vibrator.

2. Description of the Related Art

In order to conduct printing at high speed and high density, it would be desirable to increase the number of nozzle openings per recording head. Since an ink jet type recording head requires as many pressure applying means for applying pressure to ink as the number of nozzle openings and requires uniform pressure applying performance, the pressure applying means may be in the lowest production yield among head forming members.

In order to overcome this problem, the following recording head forming technique has been adopted. A pressure generating unit of a recording head is designed to have a comparatively small number of pressure generating means, and a plurality of such pressure generating units are arranged in a main scanning direction on a relatively easily manufacturable passage unit that has nozzle openings, reservoirs, and the like. Accordingly, the recording head can be formed with a large number of nozzle openings.

However, in this design, the thickness of the walls of adjacent pressure generating units is larger than a nozzle opening arraying pitch. Therefore, the pressure generating units must be arranged so as to be shifted by the width of a single unit, which in turn imposes the problem that the width of the recording head becomes about twice as much as the width of the pressure generating unit. In addition, only a small inclination produced at the time of -attaching the recording head to the recording apparatus lead to a grave error in the dot forming position between nozzle openings for black ink and nozzle openings for color inks, and this grave error greatly affects print quality. Therefore, highly accurate positioning is required for pressure generating unit assembling operation, which in turn makes the assembling operation difficult.

SUMMARY OF THE INVENTION

In the present invention, an ink jet type recording head comprising a plurality of pressure generating units, each the pressure generating unit comprising: a pressure generating means; a plurality of pressure generating chambers for pressurizing ink through actuation of the pressure generating means; a plurality of pressure generating units housing the pressure generating chambers; and a passage unit on which the pressure generating units are arranged, the passage unit having reservoirs formed therein, at least one reservoir extending so as to cross over a plurality of pressure generating units; in which the pressure generating chambers are arranged in line along an arrangement direction;

the pressure generating chambers are inclined at an angle θ with respect to the arrangement direction; outer walls of the pressure generating units in the arrangement direction are inclined at an angle θ with respect to the arrangement direction, thereby providing an inclination for of the pressure generating units; the pressure generating units are arranged on the passage unit such that each pressure generating unit is shifted in a sheet forward direction along the inclination of an adjacent one of the pressure generating units away from a position aligned with the adjacent pressure generating unit; and an amount of shift between each pressure generating unit and the adjacent pressure generating unit is set such that a pitch (hereinafter referred to as the "design pitch" whenever applicable) between first opposing ones of the pressure generating chambers that oppose each other across the outer walls of the pressure generating unit and the adjacent pressure generating unit is equal to a pitch between second opposing ones of the pressure generating chambers that oppose each other on the pressure generating unit.

Since the outer walls of the opposing pressure generating units are inclined with respect to a line orthogonal to a pressure generating chamber arraying direction, a nozzle opening arraying pitch at a boundary region between the opposing pressure generating units can be adjusted to the design pitch by shifting one of the opposing pressure generating units in parallel along the outer walls thereof. That is, if one of the opposing pressure generating units is shifted in parallel along the outer walls thereof, the distance between the pressure generating chambers belonging to the opposing pressure generating units in the pressure generating chamber arraying direction is changed, so that the nozzle opening arraying pitch at the boundary region between the opposing pressure generating units can be adjusted to the design pitch. Since this shifted distance is extremely small compared with the width of each pressure generating unit, the width of the recording head as a whole can be made smaller than a product of the width of a pressure generating unit and the number of pressure generating units arranged in the recording head moving direction.

Therefore, a first object of the invention is to provide an ink jet type recording head capable of increasing the number of nozzle openings per recording head using a plurality of units without significantly increasing the width of the recording head.

Further, a second object of the invention is to provide an ink jet type recording head capable of jetting a plurality of kinds of ink drops by providing a plurality of reservoirs, at least one reservoir communicating with a plurality of pressure generating units.

Still further, a third object of the invention is to provide a flexible cable capable of being connected to a plurality of actuators with ease.

DETAILED DESCRIPTION OF THE PREFERRED EMBODIMENTS

Figure 1:
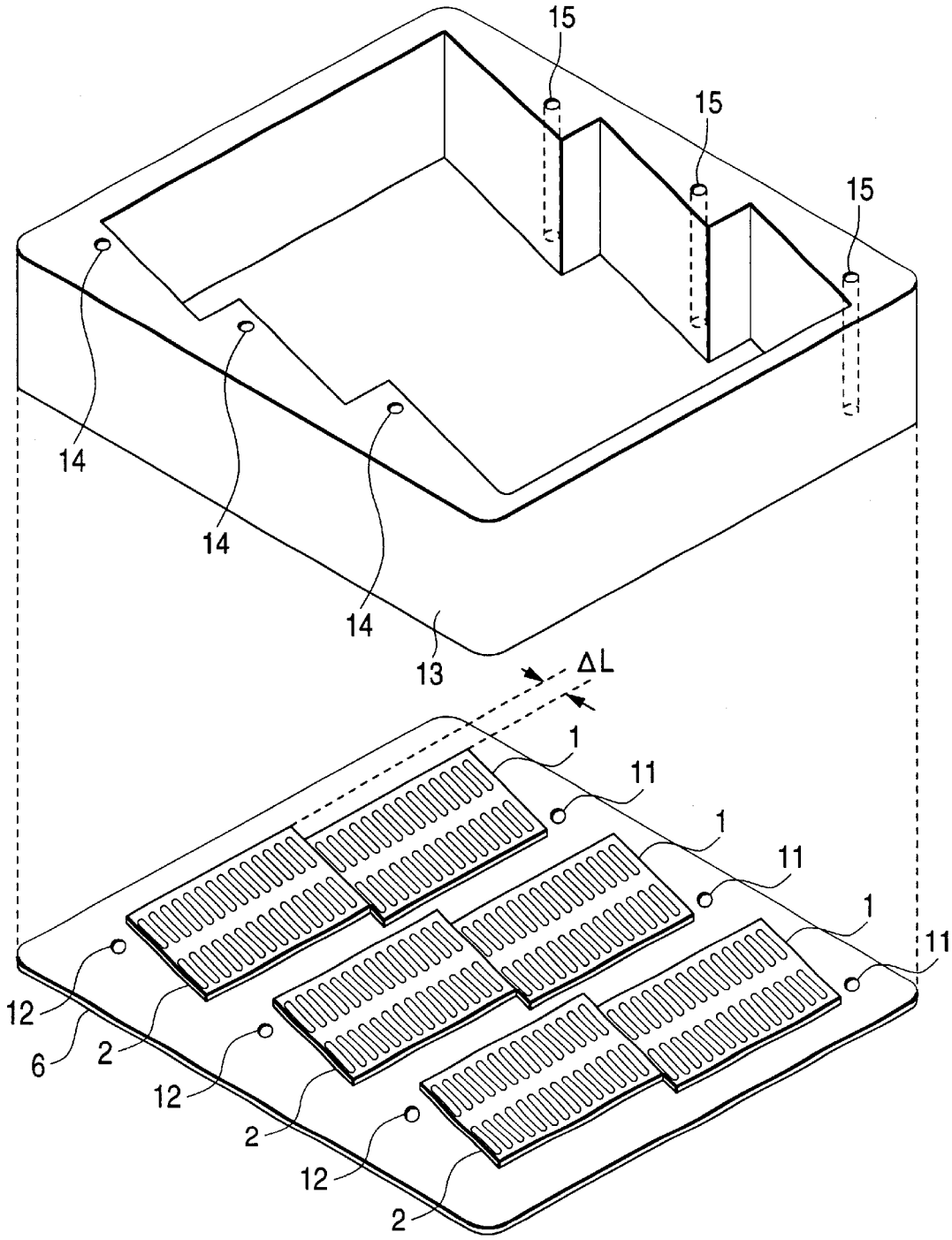
FIG. 1 is a perspective view showing a recording head, which is an embodiment of the invention.
Figure 2:
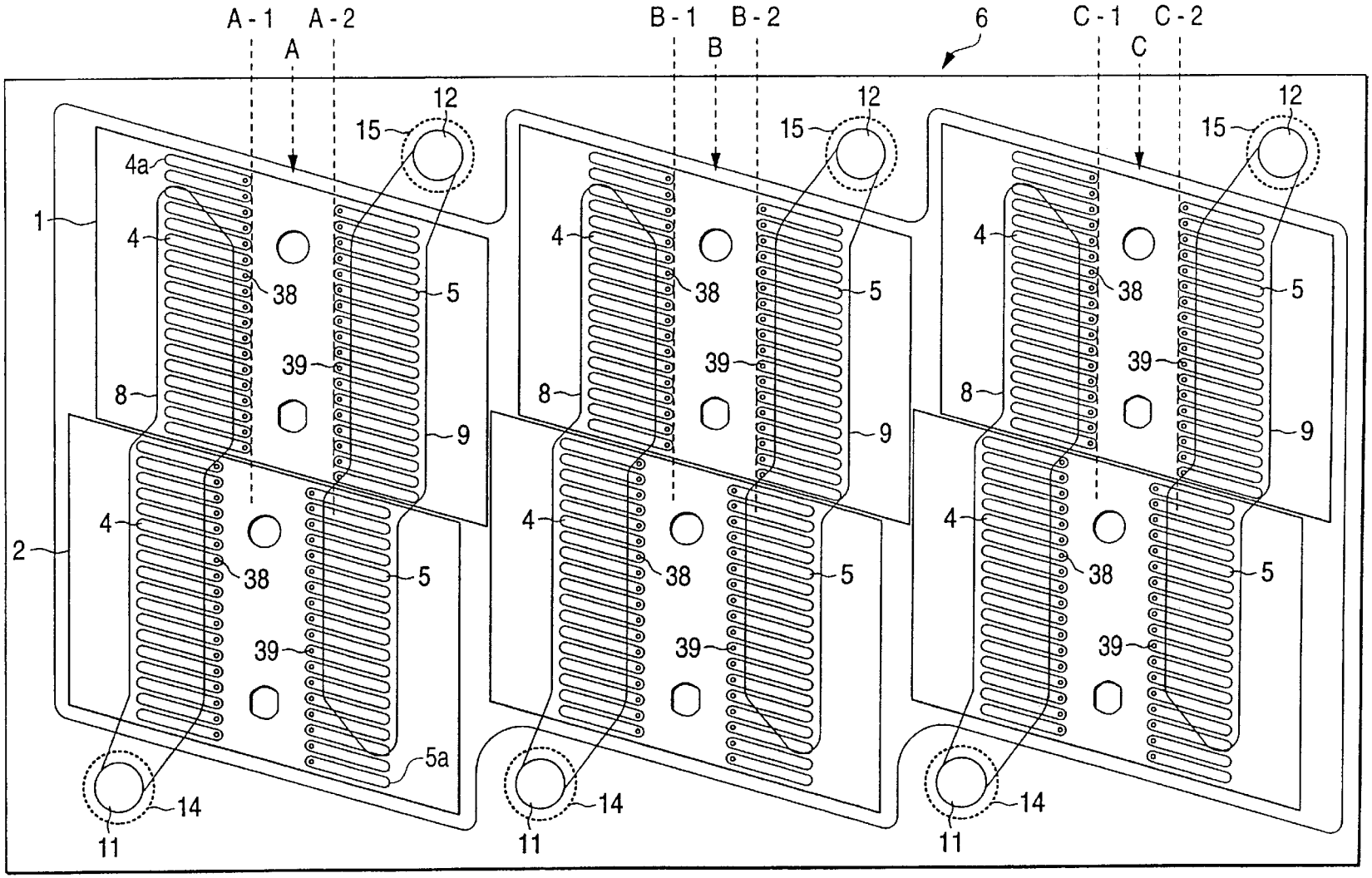
FIG. 2 is a diagram showing an ink passage structure centering on pressure generating chambers with a vibrating plate and ink supply tubes removed.

FIG. 1 and FIG. 2 show an embodiment of the invention. Reference numerals 1 and 2 denote pressure generating units that will be described later. The pressure generating units are designed under the same specification. A plurality of pressure generating units are arranged in three arrays, each array including two vertically arranged units. These three arrays of pressure generating units are fixed to a surface of a passage unit 6, which will be described later, so as to be shifted at a distance AL, which will be described later, in a main scanning direction, i.e., in a recording head moving direction equidistantly. The passage unit 6 functions also as a fixing member.

Each of the pressure generating unit 1 and the pressure generating unit 2 includes two independent arrays of pressure generating chambers 4, 5. The pressure generating chambers 4, 4 of the upper and lower pressure generating units 1, 2, and the pressure generating chambers 5, 5 of the upper and lower pressure generating units 1, 2 are arranged to respectively communicate with reservoirs 8, 9 that are formed in the passage unit 6. As best shown in FIG. 2, at least one pressure generating chamber 4*a* is disposed so that it is not in communication with reservoirs 8, 9. Each reservoir extends so as to cross over the two pressure generating units 1, 2.

Ink introducing ports 11, 12 are formed at diagonal points of the confronting upper and lower pressure generating units 1, 2 for each of the three pressure generating unit arrays A, B, C. The ink introducing ports 11, 12 supply ink to the reservoirs 8, 9, respectively. Ink supply tubes 14, 15 are erected on the passage unit 6 so as to communicate with the ink introducing ports 11, 12. Accordingly, ink can be supplied independently to the reservoirs 8, 9 that communicate with the pressure generating chambers 4, 5 belonging to the same pressure generating unit array.

Since the reservoirs 8, 9 are independent of each other, ink drops of different colors can be jetted out of the respective nozzle opening arrays A-1, A-2, B-1, B-2, C-1, C-2. For example, black ink is supplied to the reservoirs corresponding to nozzle opening arrays A-1, A-2, B-1 by arranging the nozzle opening arrays A-1, A-2, B-1 at the same pitch and so as to be close to one another; and cyan, magenta, and yellow inks are supplied to the reservoirs corresponding to the nozzle opening arrays B-2, C-1, C-2 by arranging the nozzle opening arrays B-2, C-1, C-2 so as to coincide with an auxiliary scanning direction, i.e., with a line parallel to a carriage moving direction. Accordingly, a recording head that can produce high-density monochromatic and color images can be obtained.

Further, the ink introducing ports 11, 12 that supply inks from external tanks to the reservoirs 8, 9 of the respective pressure generating units 1, 2 are arranged at the diagonal points of the two pressure generating units 1, 2 belonging to each of the respective arrays A, B, C in this embodiment. Therefore, the ink supply tubes 14, 15 can be arranged while effectively utilizing the dead space of the stepped portions formed by the boundaries of the respective arrays A, B, C. As a result, the recording head can be downsized as a whole.

Figure 3:
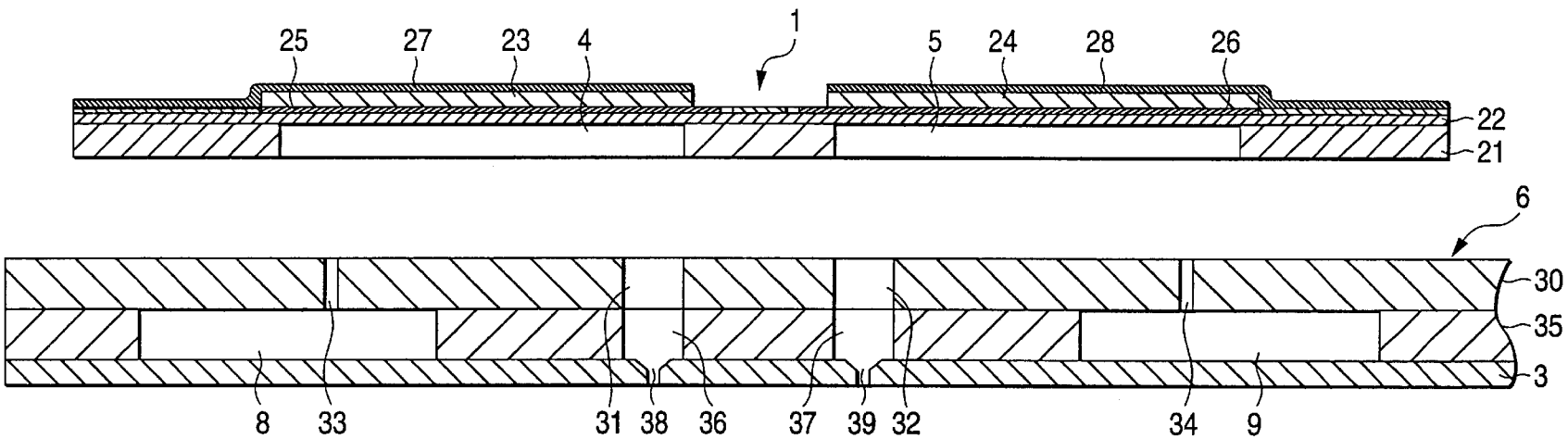
FIG. 3 is a diagram showing an ink jet type recording head, which is an embodiment of the invention in the form of a sectional structure close to pressure generating chambers.

FIG. 3 shows embodiments of the aforementioned pressure generating unit and the passage unit 6. Since each of the pair of pressure generating units 1, 2 has the same construction, only the pressure generating unit 1 will be described.

Figure 5:
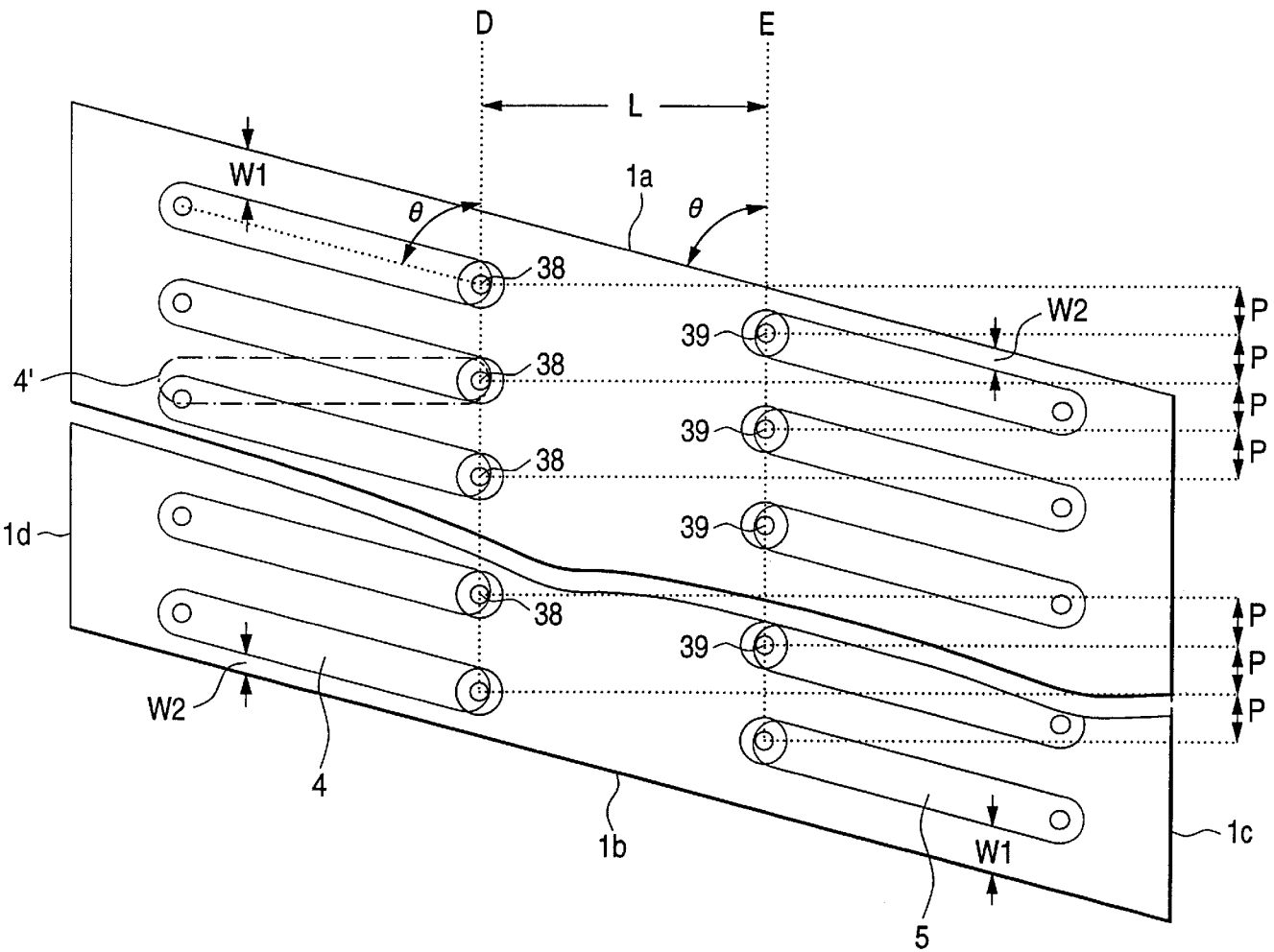
FIG. 5 is a diagram showing a layout of pressure generating chambers in a pressure generating unit.
Figure 6:
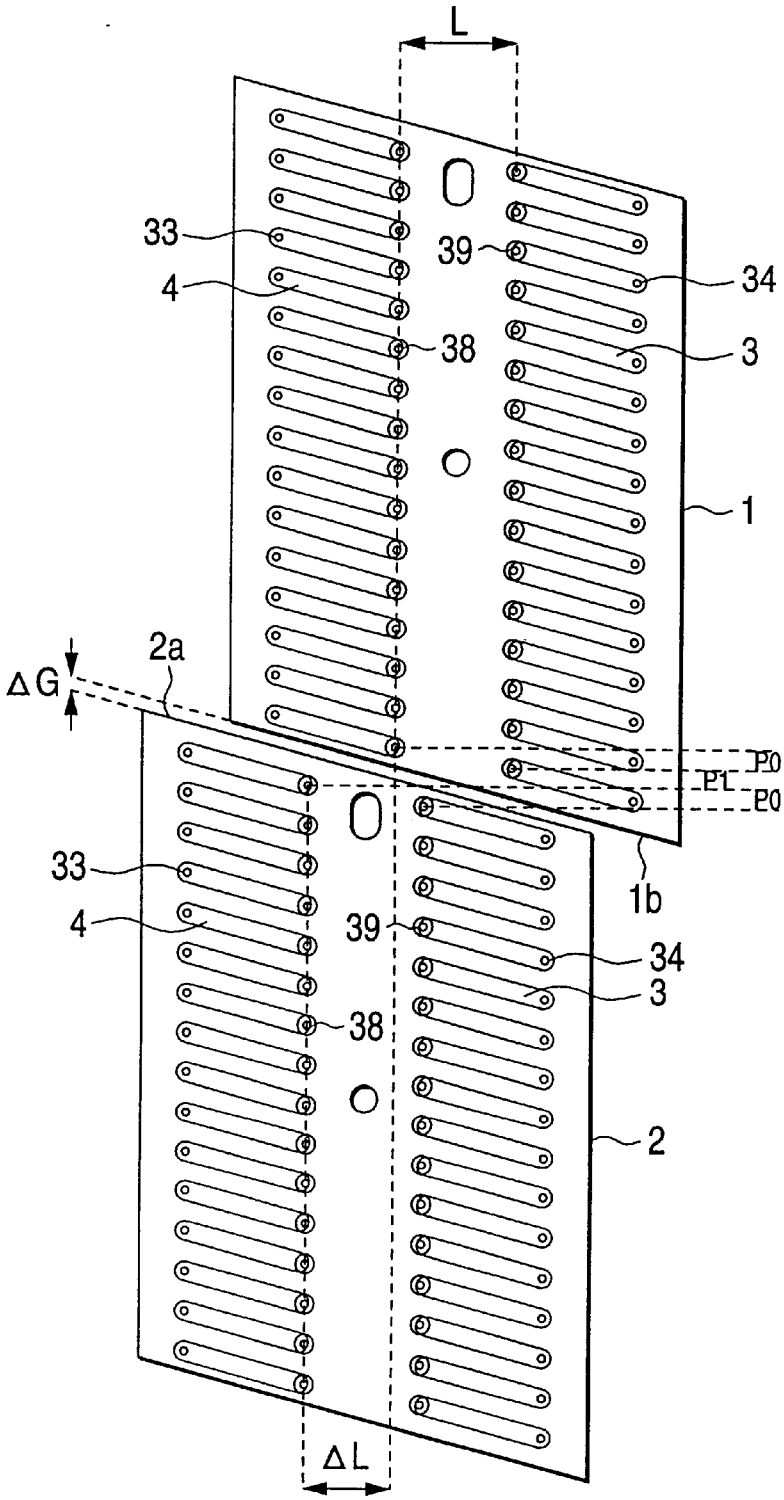
FIG. 6 is a diagram showing a positional relationship between two pressure generating units forming a single array.

The pressure generating unit 1 will be described first. Reference numeral 21 denotes a spacer. The spacer 21 has the pressure generating chambers 4, 5 arranged in a plate made of a ceramic such as a zirconia ($ZrO_2$) plate having a thickness suitable for forming the pressure generating chambers 4, 5 whose depth is about 150 $\mu$p As shown in FIG. 5, the pressure generating chambers 4, 5 are arranged so that the axial line along the length of each of the pressure generating chambers 4, 5 forms an acute angle $\theta$ with respect to nozzle opening 38, 39 arraying lines D, E. The acute angle $\theta$ is preferably set to be greater than 45 degrees and less than 90 degrees (i.e. $45° < \theta < 90°$)

Further, outer walls 1*a*, 1*b* extending along the pressure generating chamber 4, 5 arraying direction (vertical direction as viewed in FIG. 5) are formed so as to be substantially parallel to the axial lines along the length of the pressure generating chambers 4, 5. Outer walls 1*c*, 1*d* in the other direction (horizontal direction as viewed in FIG. 5) are formed so as to be substantially parallel to the nozzle opening 38, 39 arraying lines D, E. The outer walls 1*a*, 1*b* adjacent to the other pressure generating unit are formed so that the thicknesses thereof W1, W2 are as thin as possible.

By arranging the pressure generating chambers 4, 5 so that the axial line thereof is inclined by the acute angle $\theta$ with respect to the nozzle opening arraying line, pressure generating chambers whose length is larger can be arranged within pressure generating units of the same width compared with a pressure generating chamber 4' that is arranged at a right angle. Therefore, this pressure generating chamber arrangement could allow a designer to meet capacity requirements with more ease in the case where the width of a pressure generating unit must be reduced for high-density design.

Reference numeral 22 denotes a vibrating plate. The vibrating plate 22 is made of a material that provides a sufficient bonding force when fired integrally with the spacer 21 and also is elastically deformable by deflection displacement of piezoelectric vibrators 23, 24 that will be described later. The vibrating plate 22 is made of the same zirconia thin plate as the spacer 21 in this embodiment, the thickness of the vibrating plate being 10 $\mu$m.

Reference numerals 23, 24 denote the aforementioned piezoelectric vibrators. The piezoelectric vibrators 23, 24 are formed on common electrodes 25, 26 by sintering a green sheet made of a piezoelectric material, the common electrodes 25, 26 being formed on the vibrating plate 22. Segment electrodes 27, 28 are formed on the piezoelectric vibrators 23, 24.

The passage unit 6 will be described next. A cover plate 30 that seals the other surface of the spacer 21 in FIG. 3 is made of a zirconia thin plate whose thickness is 150 μm in this embodiment. Formed in the cover plate 30 are communicating holes 31, 32 and ink supply ports 33, 34. The communicating holes 31, 32 connect the nozzle openings 38, 39 of a nozzle plate 3 to the pressure generating chambers 4, 5. The ink supply ports 33, 34 allow ink in the reservoirs 8, 9 to flow into the pressure generating chambers 4, 5 while connecting the reservoirs 8, 9 to the pressure generating chambers 4, 5 and ensuring a passage resistance necessary for jetting ink drops.

Figure 4:
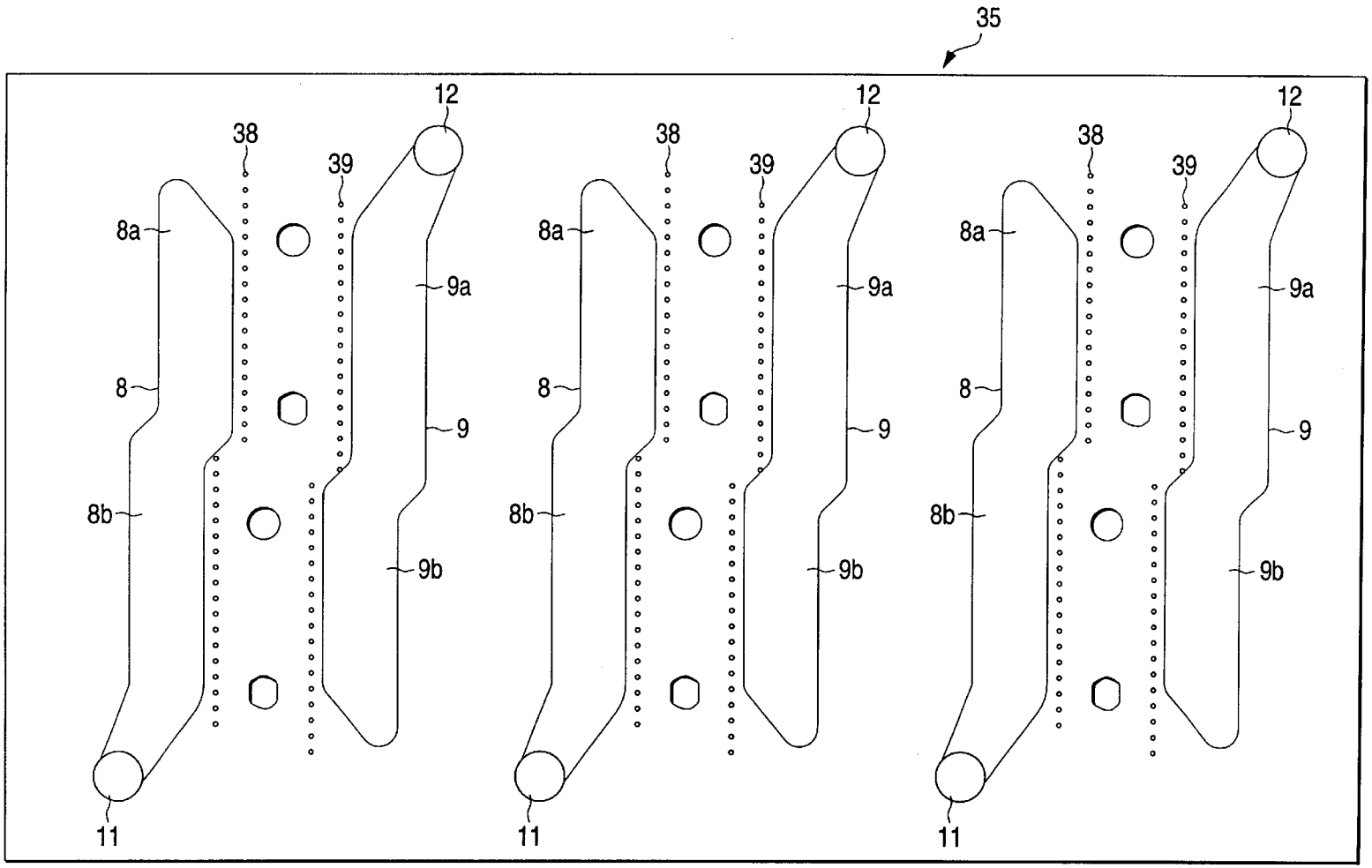
FIG. 4 is a front view showing an embodiment of an ink passage forming-board.

An ink supply passage forming board 35 is formed of a plate member having corrosion resistance such as a stainless steel whose thickness is suitable for forming ink passages, e.g., 150 μm. Formed in the ink supply passage forming board 35 are through holes serving as the reservoirs 8, 9 and communicating holes 36, 37 connecting the pressure generating chambers 4, 5 to the nozzle openings 38, 39. These reservoirs 8, 9 are divided into upper regions 8*a*, 9*a* and lower regions 8*b*, 9*b* so as to match the positions of the pressure generating chambers 4, 5 of the respective pressure generating units 1, 2 that are fixed so as to be shifted by ΔL on the cover plate 30 as shown in FIG. 4. Each of the reservoirs 8, 9 is formed as a single continuous whole with the upper region 8*a*, 9*a* thereof shifted by ΔL with respect to the lower region 8*b*, 9*b* thereof. The ink introducing port 11 is formed in the lower end of the reservoir 8, and the ink introducing port 12 is formed in the upper end of the reservoir 9, the ink introducing ports 11, 12 allowing ink from an external source to flow thereinto.

The nozzle plate 3 has two sets of nozzle openings 38, 39 that confront each other at a predetermined distance L. The set of nozzle openings 38 in the pressure generating unit 1 is arranged so as to be shifted by ΔL with respect to the set of nozzle openings 38 in the pressure generating unit 2 in the main scanning direction. This shifting distance ΔL is selected in such a manner that the respective pressure generating units 1, 2 do not overlap one upon another when the two pressure generating units 1, 2 are fixed and in such a manner that a nozzle opening pitch in the sheet forward direction between the confronting pressure generating units 1, 2 equals a pitch P0 between a nozzle opening 38 and a nozzle opening 39 designed for a single pressure generating unit.

That is, the first pressure generating unit 1 and the second pressure generating unit 2 that form each of the arrays A, B, C are fixed to the passage unit 6 so as to be shifted by ΔL in such a manner that the distance P1 between the lowermost nozzle opening 39 of the first pressure generating unit 1 and the uppermost nozzle opening 38 of the second pressure generating unit 2 in the boundary region between the first pressure generating unit 1 and the second pressure generating unit 2 coincides with the nozzle opening design pitch P0, and so as to provide a gap ΔG if necessary. That is, since the lower outer wall 1*b* and the upper outer wall 2*a* of the vertically arranged first and second pressure generating units 1, 2 are arranged so as to be inclined at the angle θ with respect to the nozzle opening arraying lines D, E, the pitch P1 at the boundary region between the first and second pressure generating units 1, 2 can be arranged to coincide with the design pitch P0 set for a pressure generating unit only by setting an extremely small shifting distance ΔL compared with the width of each of the pressure generating units 1, 2.

The thus constructed recording head can print data similarly to the conventional recording head by applying a print signal while shifting the print timing by a number of dots corresponding to the distance ΔL between the first pressure generating unit 1 and the second pressure generating unit 2 belong to each pressure generating unit array. Further, between the pressure generating unit arrays, dots belonging to each array can be printed so as to be superposed one upon another by applying a print signal while shifting the print timing by a number of dots corresponding to the distance between the arrays A, B, C.

While the case where there are three pressure generating unit arrays has been described in the aforementioned embodiment, it is apparent that the invention can be similarly applied to a case where there are four or more arrays.

Figure 7:
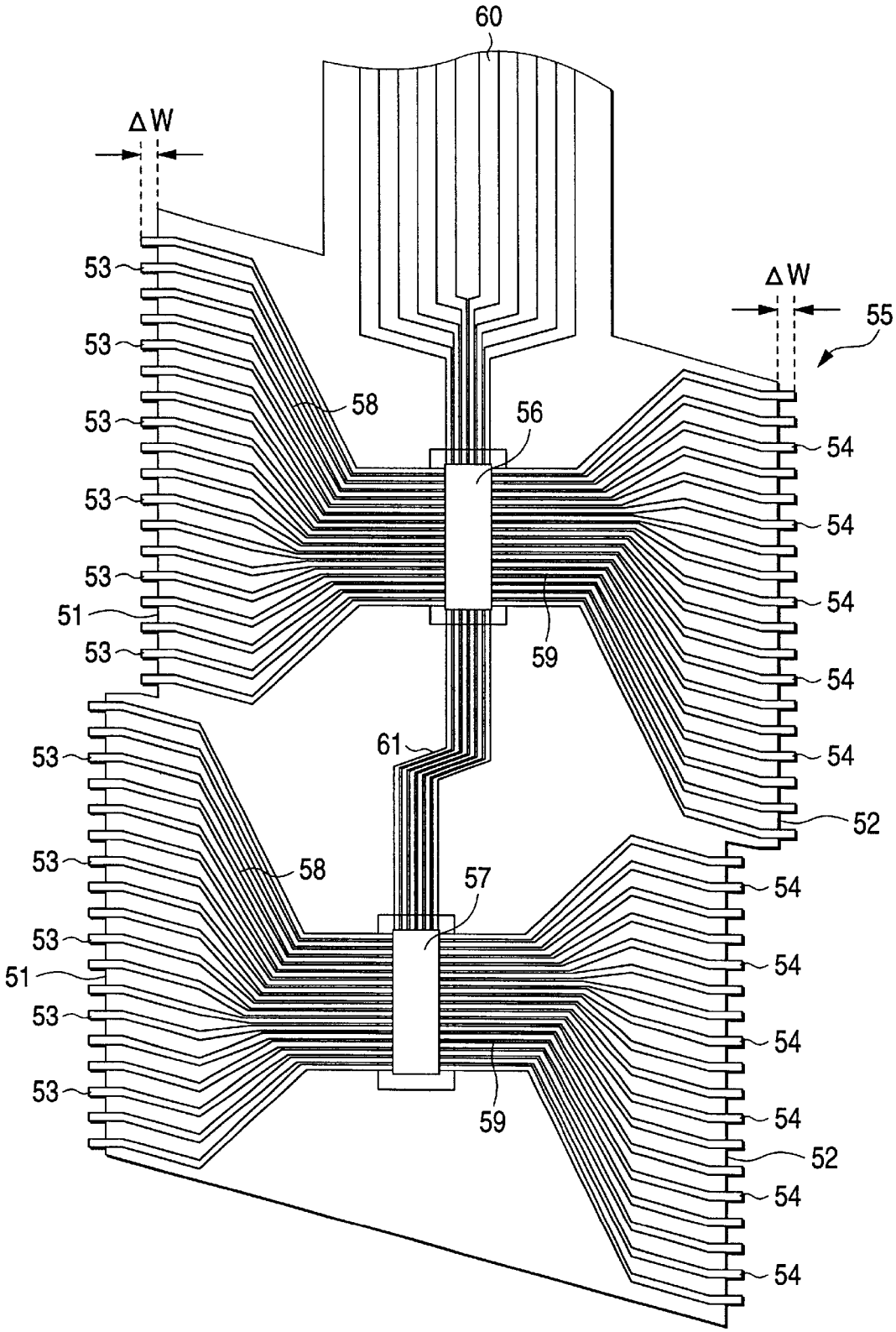
FIG. 7 is a diagram showing an embodiment of a flexible cable that supplies drive signals to a plurality of pressure generating units in each pressure generating unit array of the recording head.
Figure 9:
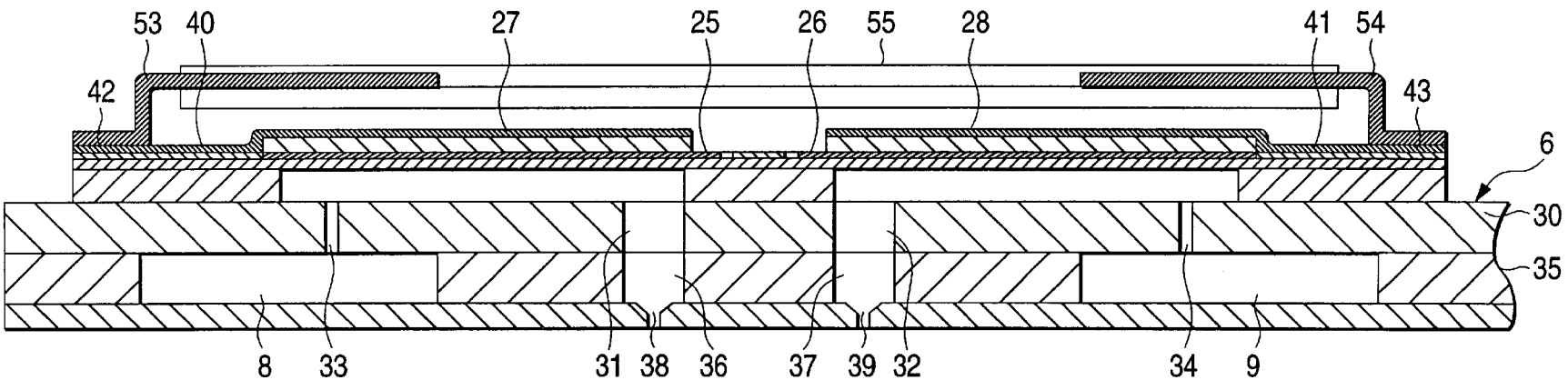
FIG. 9 is a sectional view showing a condition in which the flexible cable has been connected.

FIG. 7 shows an embodiment of a flexible cable suitable for supplying drive signals to the aforementioned recording head. The flexible cable 55 is prepared using a flexible conductive material that is formed by bonding a metal foil made of copper or the like to a heat-resistant electrically insulating base member such as polyimide. The flexible cable 55 is formed by cutting such flexible conductive material in the following manner. The length of the flexible cable 55 is such that the pressure generating units 1, 2 forming the recording head can be covered thereby. The width of the flexible cable 55 is large enough to allow the widthwise ends thereof to come in contact with connecting terminal portions 42, 42, 42, . . . , 43, 43, 43 . . . that are connected to the segment electrodes 27, 27, 27, . . . , 28, 28, 28, . . . and to conductive patterns 40, 40, 40, . . . , 41, 41, 41 . . . , respectively. More preferably, the flexible cable 55 is formed by cutting the flexible conductive material into bandlike pieces, each piece having a width larger by about ΔW, so that the bandlike pieces can be connected by bending while having a predetermined space with respect to the segment electrodes 27, 28 of the piezoelectric vibrators 23, 24 as shown in FIG. 9. In the thus formed flexible cable 55, tabs 53, 53, 53, . . . , 54, 54, 54, . . . are formed on the end portions of side surfaces 51, 52 that extend along the length of the flexible cable 55 so as to extend in a vertical direction with respect to the side surfaces 51, 52. The tabs have the same arraying pitch as the connecting terminal portions 42, 42, 42, . . . , 43, 43, 43, . . . of the pressure generating unit 1. These tabs 53, 53, 53, . . . , 54, 54, 54, . . . are formed Z-shaped while bent along the lines parallel to the side surfaces 51, 52.

This embodiment is designed in such a manner that semiconductor integrated devices 56, 57 that produce drive signals based on a print signal applied from outside are mounted on the flexible cable 55, and that the drive signals outputted from the semiconductor integrated circuits 56, 57 are supplied to the tabs 53, 53, 53, . . . , 54, 54, 54, . . . formed integrally with conductive patterns 58, 59. A print signal from an external drive circuit is applied to these semiconductor integrated devices 56, 57 by a conductive pattern 60 or 61 that extends toward one side of the flexible cable 55.

Figure 8:
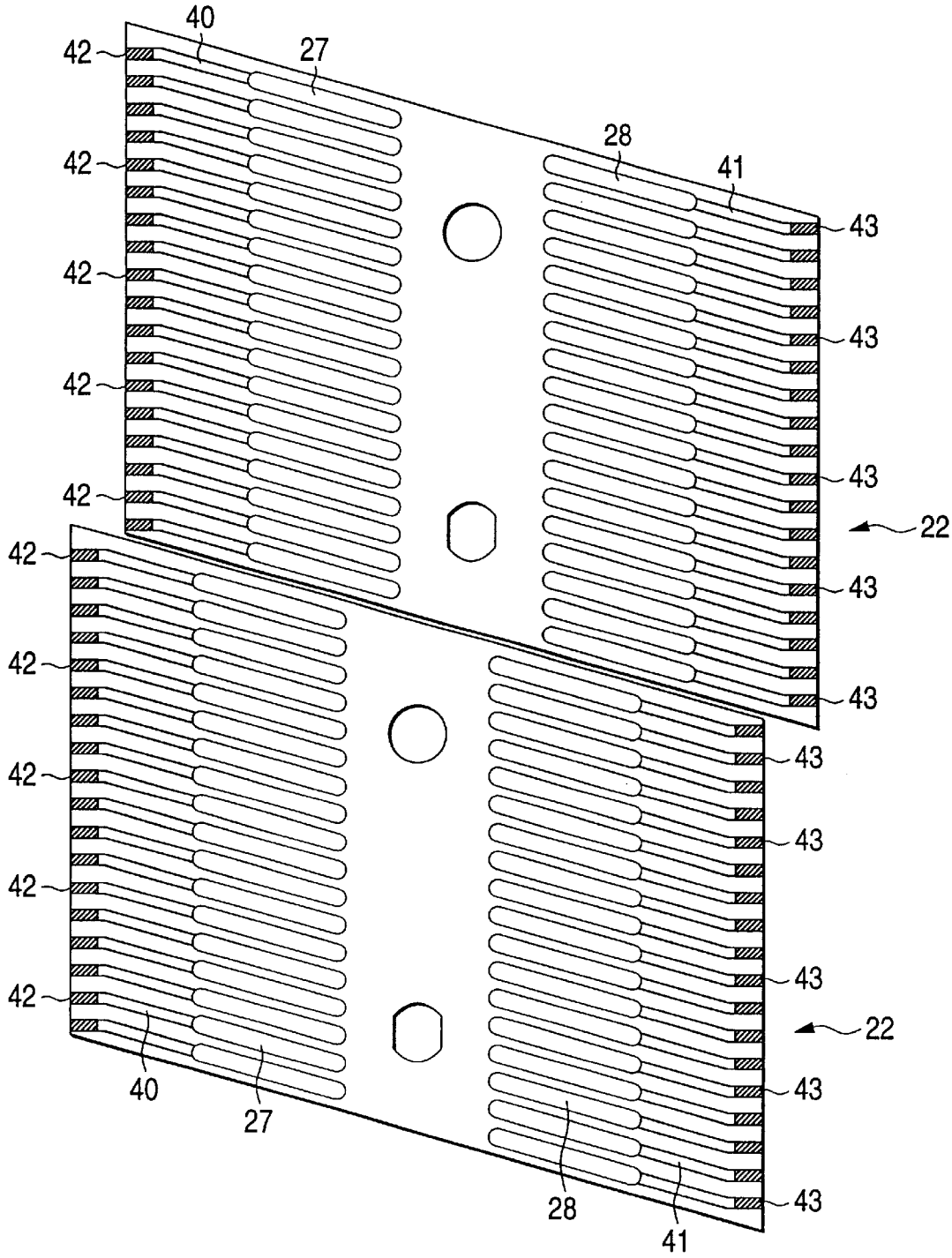
FIG. 8 is a diagram showing an arrangement of segment electrodes, connecting patterns, and connecting terminal portions of the recording head.

In the thus constructed flexible cable 55, the side surfaces 51, 52 thereof extend in parallel to the side walls of the vertically arranged pressure generating units 1, 2, and the tabs 53, 53, 53, . . . 54, 54, 54, . . . are positioned so as to confront the connecting terminal portions 42, 42, 42, . . . , 43, 43, 43, . . . of the respective pressure generating units 1, 2. The flexible cable 55 is bonded with the conducting relationship formed by soldering or the like. In positioning the flexible cable 55, the tabs 53, 53, 53, . . . , 54, 54, 54, . . . are formed so as to be substantially vertical with respect to the side surfaces 51, 52 of the flexible cable 55. Therefore, when the side surfaces 51, 52 of the flexible cable 55 are positioned so as to extend in parallel to the left and right side walls of the pressure generating units 1, 2 and so as to correspond to the respective connecting terminal portions 42, 42, 42, . . . , 43, 43, 43, . . . as viewed in FIG. 8, all the tabs 53, 53, 53, . . . , 54, 54, 54, . . . can be arranged at connectable positions.

Figure 10:
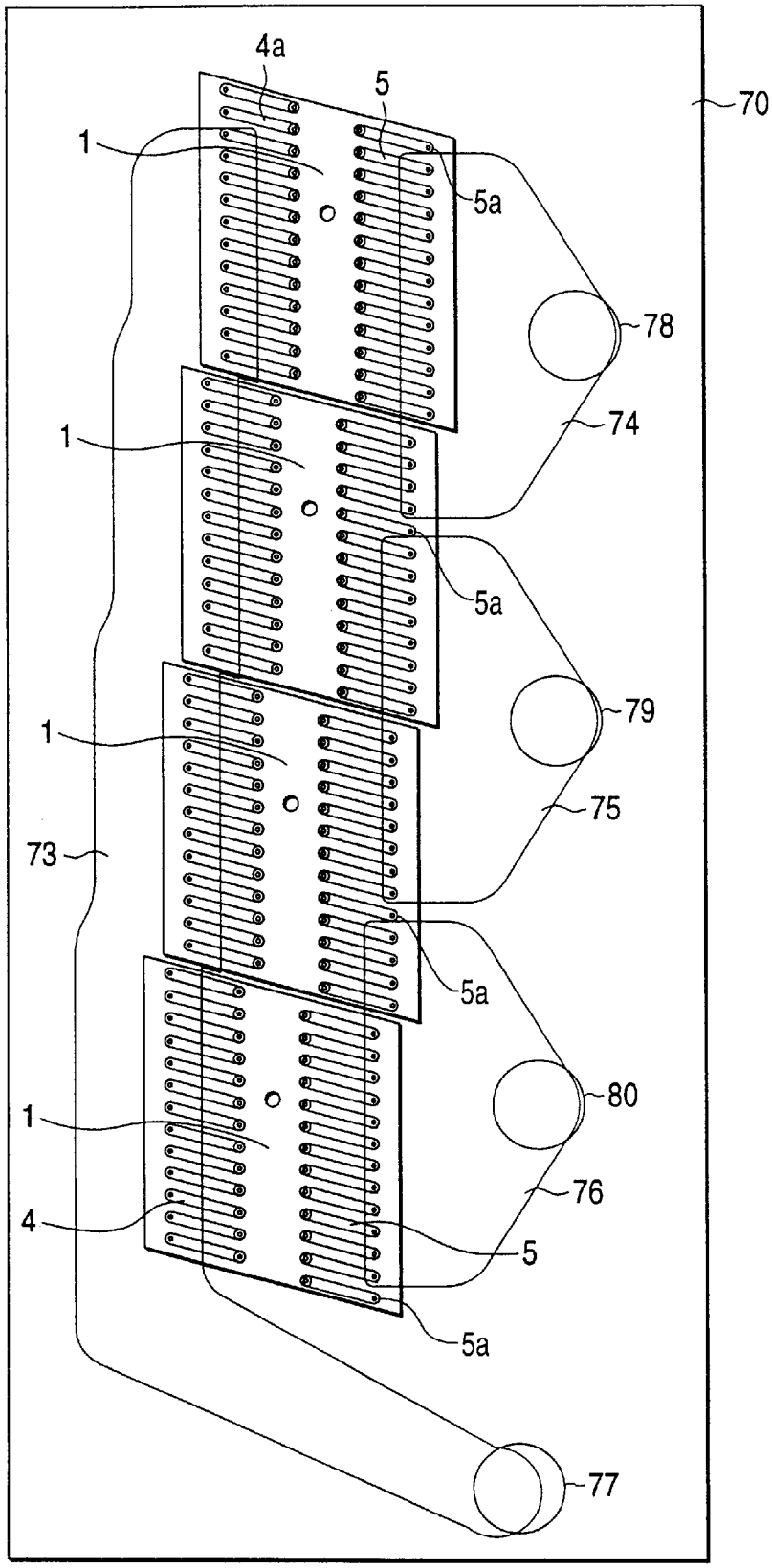
FIG. 10 is a diagram showing another embodiment of the invention in the form of a reservoir structure.
Figure 11:
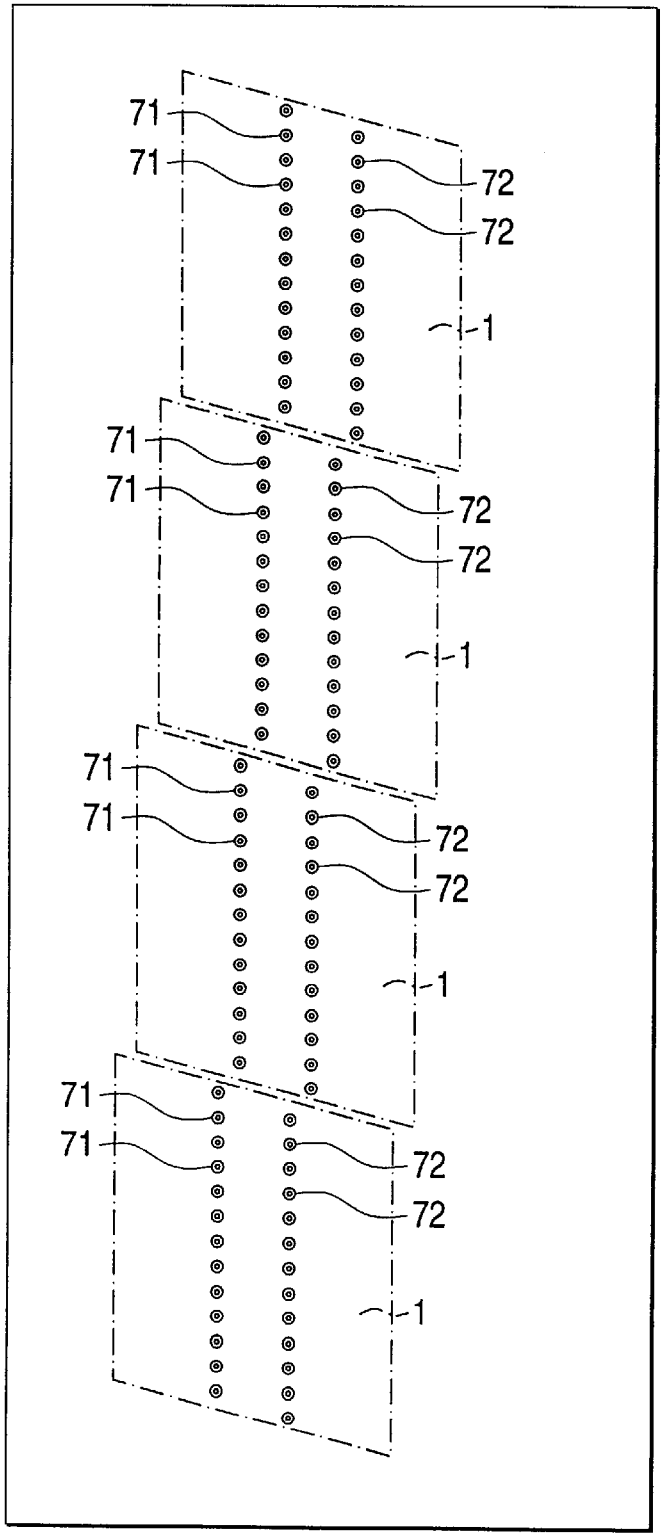
FIG. 11 is a diagram showing an embodiment of a passage unit used in the aforementioned recording head as viewed from a relationship between a nozzle opening arrangement and pressure generating units.

FIG. 10 shows a second embodiment of the invention. Reference numerals 1, 1, 1, 1 denote the aforementioned pressure generating units. These pressure generating units are fixed to a passage unit 70, which will be described later, in such a manner that the pressure generating units are shifted by the predetermined distance ΔL from each other so that the nozzle openings are pitched uniformly at the boundary region therebetween as described above. As shown in FIG. 11, the passage unit 70 communicates with the pressure generating chambers 4, 5 of the pressure generating units 1, 1, 1, 1, and has nozzle openings 71, 71, 71, . . . , 72, 72, 72, . . . formed at a predetermined pitch in such a manner that two horizontally adjacent nozzle openings are on a single line.

Further, a slenderly extending reservoir 73 is formed in one side (on the left side as viewed in FIG. 10) so as to communicate with all the pressure generating chambers 4 of the four pressure generating units 1, 1, 1, 1. On the other hand, reservoirs 74, 75, 76 are formed on the other side (on the right side as viewed in FIG. 10), each reservoir being formed so as to communicate with a number of pressure generating chambers 5 of the four pressure generating units 1, 1, 1, 1, the number being defined by dividing all the pressure generating chambers 5 into three equal groups, with one pressure generating chamber 5*a* separating each group in this embodiment. That is, each of the reservoirs 74, 75, 76 covers a total group of 16 pressure generating chambers in this embodiment so that one pressure generating chamber 5*a* on each side of any one group is not connected to any one of the reservoirs. The black ink is supplied to the reservoir 73 through an ink introducing port 77, and the yellow, magenta, and cyan inks are supplied to the reservoirs 74, 75, 76 through ink introducing ports 78, 79, 80.

The thus constructed recording head is mounted on the carriage in such a manner that the lines of arrangement of the respective nozzle openings 71, 71, 71, . . . , 72, 72, 72, . . . coincide with the auxiliary scanning direction, i.e., the sheet forward direction. As a result, the black ink is supplied to the reservoir 73 formed on one side of the passage unit 70, and the yellow, magenta, and cyan inks are supplied to the three reservoirs 74, 75, 76 formed on the other side of the passage unit 70. A dot forming signal for black is applied to all the piezoelectric vibrators 23 of the pressure generating chambers 4 on one sides of the respective pressure generating units 1, 1, 1, 1; a dot forming signal for yellow is applied to all the piezoelectric vibrators 24 corresponding to the group of pressure generating chambers 5 communicating with the reservoir 74; a dot forming signal for magenta is applied to all the piezoelectric vibrators 24 corresponding to the group of pressure generating chambers 5 communicating with the reservoir 75; and a dot forming signal for cyan is applied to all the piezoelectric vibrators 24 corresponding to the group of pressure generating chambers 5 communicating with the reservoir 76.

Therefore, when a dot forming signal for black has been fed, the piezoelectric vibrators 23 apply pressure to the pressure generating chambers 4, 4, 4, . . . , so that ink drops are jetted out of the nozzle openings 71, 71, 71, . . . on one side. Further, when dot forming signals for color inks have been fed, the piezoelectric vibrators 24, 24, 24 apply pressure to the pressure generating chambers 5, 5, 5, . . . on the other side of the pressure generating units 1, 1, 1, 1, so that dots of color inks can be formed along the same line as the dots formed by the black ink.

By the way, since the nozzle openings 72, 72, 72 . . . are pitched at an interval substantially equal to thirteen (13) dots in the sheet forward direction, dots of different colors can be formed at the same position by causing the sheet forward distance to coincide with the recording widths of the respective colors. The printing operation is performed by repeating such process.

On the other hand, in the case where text data and monochromatic image data are to be printed, if a drive signal is applied only to the piezoelectric vibrators 23 corresponding to the vertically arranged pressure generating chambers 4 on one side, data can be printed in a recording sheet region that is approximately 3 times larger in the sheet forward direction than in the case of color printing.

While the example in which a recording head is formed of four pressure generating units has been described in this embodiment, it is apparent that similar advantages can be provided by an example in which there are so many pressure generating chambers and by an example in which two or more actuators are used, as long as such a structure that the pressure generating chambers and the actuators are divided into a region for black on one side and a plurality of regions on the other side so as to allow inks to be supplied independently to the respective regions.

Figure 12:
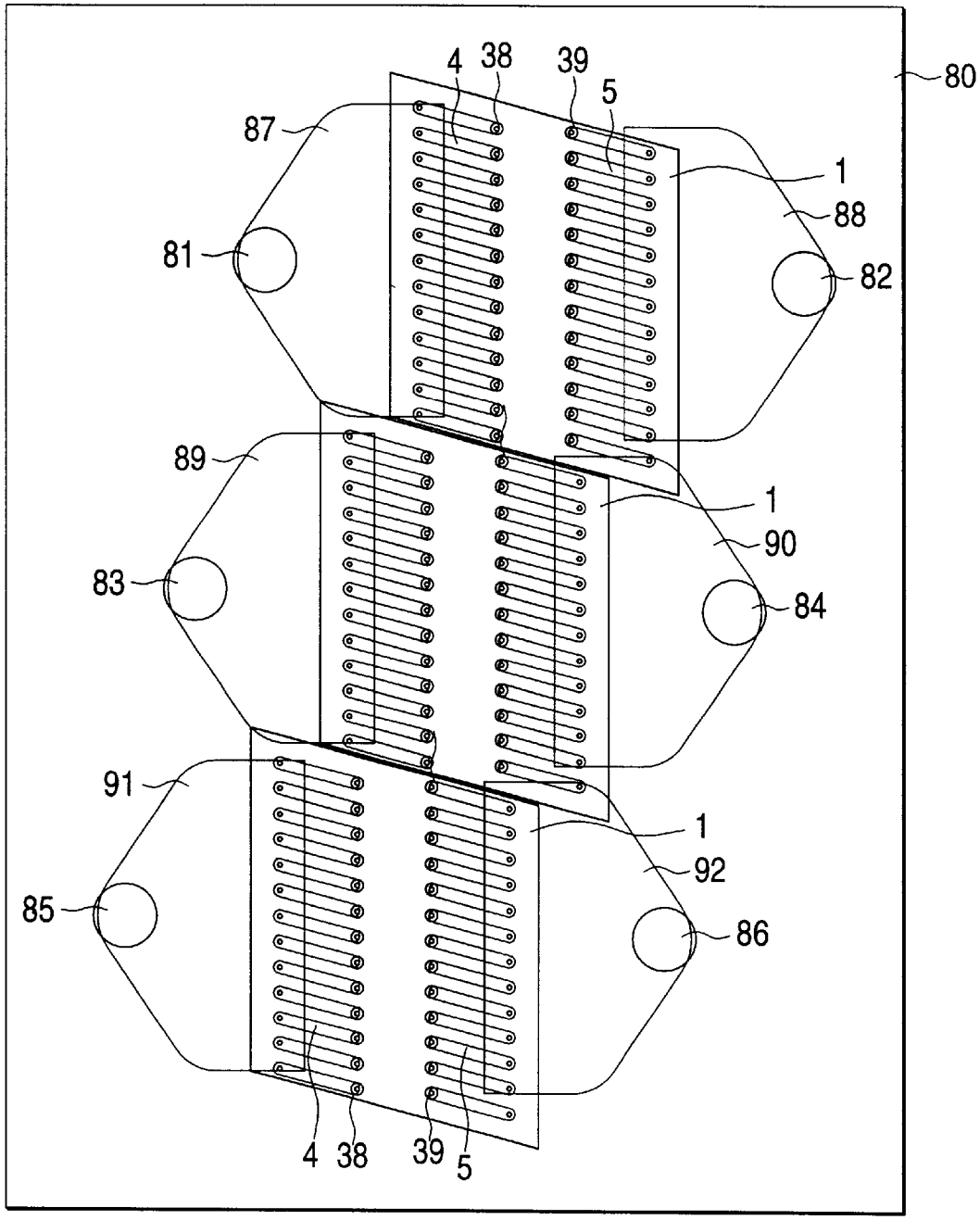
FIG. 12 is a diagram showing another embodiment of the invention in the form of a relationship between pressure generating units and reservoirs.

FIG. 12 shows another embodiment of the invention. Reference numerals 1, 1, 1 denote three pressure generating units that apply pressure to ink, the pressure-generating units 1, 1, 1 having the same structure. It is desired that the three pressure generating units be arranged on a passage unit 80 so as to be shifted at a predetermined distance in the sheet forward direction so that one side of an array of the pressure generating chambers out of the two arrays of pressure generating chambers belonging to one pressure generating unit is aligned with one side of one array of the pressure generating chambers belonging to the other adjacent pressure generating unit in the sheet forward direction.

Nozzle openings are formed in the passage unit 80. The nozzle openings communicate with the pressure generating chambers of each pressure generating unit 1. It is desired that the nozzle openings be formed so that one array of the pressure generating chambers out of the two arrays of the pressure generating chambers belonging to one pressure generating unit is aligned with the other array of the pressure generating chambers belonging to the other adjacent pressure generating unit in the sheet forward direction. Further, ink introducing ports 81, 82, 83, 84, 85, 86 are arranged so as to be positioned on both sides of the respective pressure generating units 1, 1, 1, and reservoirs 87, 88, 89, 90, 91, 92 that independently communicate with the pressure generating chambers 4, 4, 4, . . . , 5, 5, 5, . . . of the respective pressure generating units 1, 1, 1 are formed.

According to this embodiment, a recording apparatus capable of making a color printing using six colors can be downsized in the main scanning direction. That is, the recording apparatus capable of making a color printing using six colors by supplying inks of different colors, i.e., black, yellow, dark magenta, light magenta, dark cyan, and light cyan inks from external sources to the respective ink introducing ports 81 to 86 can be implemented so as to be downsized in the main scanning direction.

While the case where three pressure generating units are used has been described in this embodiment, a recording head that can jet ink drops of six or more different colors can be implemented by increasing the number of pressure generating units arranged in the sheet forward direction.

Further, while the case where the recording head uses a plurality of units that expands and contracts the pressure generating chambers by deflection vibration of the piezoelectric vibrators in the aforementioned embodiments, similar advantages can be provided by applying the invention to an example in which one end of a piezoelectric vibrator of a vertical vibration mode is caused to come in contact with an elastic plate or to an example in which pressure is applied to a pressure generating chamber by heating the pressure generating chamber using a heating element.

Further, while the case where an actuator in which the pressure generating chambers are inclined with respect to the nozzle opening arraying lines has been described in the aforementioned embodiments, it is apparent that the invention can be applied to a structure in which a nozzle opening arraying pitch in a region -where adjacent pressure generating units confront each other can be made equal to a nozzle opening arraying pitch designed for a pressure generating unit.

What is claimed is:

1. An ink jet type recording head, comprising:

a plurality of pressure generating units;

a plurality of pressure generating chambers provided in the pressure generating units, wherein the pressure generating chambers are grouped into at least two groups; and a plurality of reservoirs respectively connected to the at least two groups of the pressure generating chambers, wherein at least one pressure generating chamber is not disposed in the at least two groups but is disposed between the at least two groups of the pressure generating chambers so as not to connect to any one of the plurality of reservoirs, and wherein at least one of the reservoirs connects to more than one of the pressure generating units.

2. An ink jet type recording head according to claim 1, further comprising a communication hole in communication with said at least one pressure generating chamber.

3. An ink jet type recording head according to claims 1, further comprising a nozzle opening in communication with said at least one pressure generating chamber.

4. An ink jet type recording head, comprising:

a plurality of pressure generating units;

a plurality of pressure generating chambers provided in said plurality of pressure generating units; and at least one reservoir communicating with a group of said plurality of pressure generating chambers, wherein at least one of said plurality of pressure generating chambers is not disposed in said group, and is not in communication with any reservoir, and wherein said at least one reservoir connects to more than one of said plurality of pressure generating units.

5. An ink jet type recording head according to claim 4, further comprising a communication hole in communication with said at least one of said plurality of pressure generating chambers.

6. An ink jet type recording head according to claim 4, further comprising a nozzle opening in communication with said at least one of said plurality of pressure generating chambers.

* * * * *